US010879020B2

(12) United States Patent
Zhao et al.

(10) Patent No.: US 10,879,020 B2
(45) Date of Patent: Dec. 29, 2020

(54) SWITCH AND KEYBOARD

(71) Applicant: Microsoft Technology Licensing, LLC, Redmond, WA (US)

(72) Inventors: Kelong Zhao, Shenzhen (CN); Pengfei Lei, Shenzhen (CN); Ping Yang, Shenzhen (CN)

(73) Assignee: Microsoft Technology Licensing, LLC, Redmond, WA (US)

( * ) Notice: Subject to any disclaimer, the term of this patent is extended or adjusted under 35 U.S.C. 154(b) by 0 days.

(21) Appl. No.: 16/061,171

(22) PCT Filed: Jan. 18, 2017

(86) PCT No.: PCT/US2017/013960
§ 371 (c)(1),
(2) Date: Jun. 11, 2018

(87) PCT Pub. No.: WO2017/127437
PCT Pub. Date: Jul. 27, 2017

(65) Prior Publication Data

US 2018/0366285 A1 Dec. 20, 2018

(30) Foreign Application Priority Data

Jan. 22, 2016 (CN) ..... 2016 1 0045759

(51) Int. Cl.
*H01H 13/14* (2006.01)
*H01H 13/84* (2006.01)
(Continued)

(52) U.S. Cl.
CPC ..... *H01H 13/84* (2013.01); *H01H 13/52* (2013.01); *H01H 13/705* (2013.01);
(Continued)

(58) Field of Classification Search
CPC ..... H01H 13/705; H01H 13/83; H01H 2219/062; H01H 13/52; H01H 13/14;
(Continued)

(56) References Cited

U.S. PATENT DOCUMENTS 4,025,743 A * 5/1977 Oswald ..... H01H 15/02 200/60
4,635,167 A 1/1987 Schlosser
(Continued)

FOREIGN PATENT DOCUMENTS

CN 202454472 U 9/2012
CN 203339029 U 12/2013
(Continued)

OTHER PUBLICATIONS

"International Search Report and Written Opinion Issued in PCT Application No. PCT/US2017/013960", dated Apr. 11, 2017, 13 Pages.
(Continued)

*Primary Examiner* — Ahmed M Saeed
(74) *Attorney, Agent, or Firm* — Alleman Hall Creasman & Tuttle LLP

(57) ABSTRACT

A switch, keyboard and associated methods are provided. In one implementation, the switch includes a housing having a protruding portion configured to be received in an aperture formed on a substrate, a plunger operable to move with respect to the housing, a first contact member located in the housing, and a second contact member extending from the protruding portion of the housing. The second contact member is operable to, based at least in part on the plunger being moved in a first direction, deform to a predefined extent to electrically contact the first contact member. The switch provides a low profile appearance but not compromising the smooth and quickly responsive striking motion for a
(Continued)

mechanical switch, such that a clean design can be provided while the input experience and durability are maintained. A keyboard is also provided.

19 Claims, 3 Drawing Sheets

(51) Int. Cl.

| | |
|---|---|
| ***H01H 13/705*** | (2006.01) |
| ***H01H 13/83*** | (2006.01) |
| ***H01H 13/52*** | (2006.01) |
| ***H01H 13/88*** | (2006.01) |
| *H01H 13/36* | (2006.01) |

(52) U.S. Cl.
CPC ..... *H01H 13/83* (2013.01); *H01H 13/88* (2013.01); *H01H 13/36* (2013.01); *H01H 2201/008* (2013.01); *H01H 2203/056* (2013.01); *H01H 2219/014* (2013.01); *H01H 2219/036* (2013.01); *H01H 2223/014* (2013.01); *H01H 2223/03* (2013.01); *H01H 2227/036* (2013.01); *H01H 2235/01* (2013.01)

(58) Field of Classification Search
CPC ..... H01H 13/807; H01H 13/86; H01H 13/88; H01H 2223/014; H01H 2223/058; H01H 2231/002; H01H 3/125; H01H 71/04; H01H 1/5805; H01H 2071/042; H01H 2219/056; H01H 2219/064; H01H 2221/044; H01H 2223/002; H01H 2223/026; H01H 77/02; H01H 9/00; H01H 9/0214; H01H 9/0228; H01H 9/0264; H01H 9/04; H01H 9/047; H01H 9/12; H01H 9/16; H01H 9/22; H01H 9/26; H01H 9/282; H01H 9/342; H01H 9/52
See application file for complete search history.

(56) References Cited

U.S. PATENT DOCUMENTS

| | | | | |
|---|---|---|---|---|
| 5,521,345 | A | 5/1996 | Wulc | |
| 6,806,815 | B1 | 10/2004 | Kaikuranta et al. | |
| 7,488,910 | B2 | 2/2009 | Hong | |
| 7,982,149 | B2 | 7/2011 | Larsen et al. | |
| 8,089,776 | B2 | 1/2012 | Kjerrman et al. | |
| 8,310,466 | B2 | 11/2012 | Chen et al. | |
| 8,581,850 | B2 | 11/2013 | Fyke | |
| 8,686,948 | B2 | 4/2014 | Knighton et al. | |
| 2006/0181511 | A1 | 8/2006 | Woolley | |
| 2016/0055988 | A1* | 2/2016 | Muller | H01H 13/023 200/314 |
| 2016/0071662 | A1* | 3/2016 | Cai | H01H 13/14 200/314 |

FOREIGN PATENT DOCUMENTS

| | | | |
|---|---|---|---|
| CN | 104078261 | A | 10/2014 |
| CN | 203910616 | U | 10/2014 |
| CN | 204011192 | U | 12/2014 |
| CN | 204189679 | U | 3/2015 |
| CN | 204332780 | U | 5/2015 |
| CN | 104715952 | A | 6/2015 |
| DE | 102014212627 | A1 | 12/2015 |

OTHER PUBLICATIONS

"Second Office Action Issued in Chinese Patent Application No. 201610045759.0", dated Sep. 20, 2019, 13 Pages.
"First Office Action and Search Report Issued in Chinese Patent Application No. 201610045759.0", dated Jun. 5, 2019, 11 Pages.
"Max Keyboard Nighthawk X7 (Cherry MX Blue) Backlit Mechanical Keyboard", Retrieved from: https://web.archive.org/web/20130102051731/http://www.maxkeyboard.com/max-keyboard-nighthawk-x7-backlit-mechanical-keyboard.html, Retrieved Date: Jan. 2, 2013, 02 Pages.

* cited by examiner

SWITCH AND KEYBOARD

CROSS REFERENCE TO RELATED APPLICATIONS

The present application is a U.S. National Phase of International Patent Application Serial No. PCT/US2017/013960 entitled "SWITCH AND KEYBOARD", filed Jan. 18, 2017, which claims priority to Chinese Patent Application Serial No. 2016100457590, filed Jan. 22, 2016, the entire contents of each of which are hereby incorporated by reference for all purposes.

BACKGROUND

A switch may be used in many input device such as a keyboard or a gamepad to receive user inputs. A switch, especially a mechanical switch should be provided with a robust and durable mechanism designed for allowing millions of inputs.

SUMMARY

In accordance with implementations of the subject matter described herein, a switch having a low profile appearance is provided. The switch includes a housing having a protruding portion configured to be received in an aperture formed on a substrate, a plunger operable to move with respect to the housing, a first contact member located in the housing, and a second contact member extending from the protruding portion of the housing. The second contact member is operable to, based at least in part on the plunger being moved in a first direction, deform to a predefined extent to electrically contact the first contact member. The switch in accordance with the implementations of the subject matter described herein is capable of providing a low profile appearance but not compromising the smooth and quickly responsive striking motion for a mechanical switch, such that a clean design can be provided while the input experience and durability are maintained.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

BRIEF DESCRIPTION OF THE DRAWINGS

Throughout the drawings, the same or similar reference symbols are used to indicate the same or similar elements.

DETAILED DESCRIPTION

Figure 1:
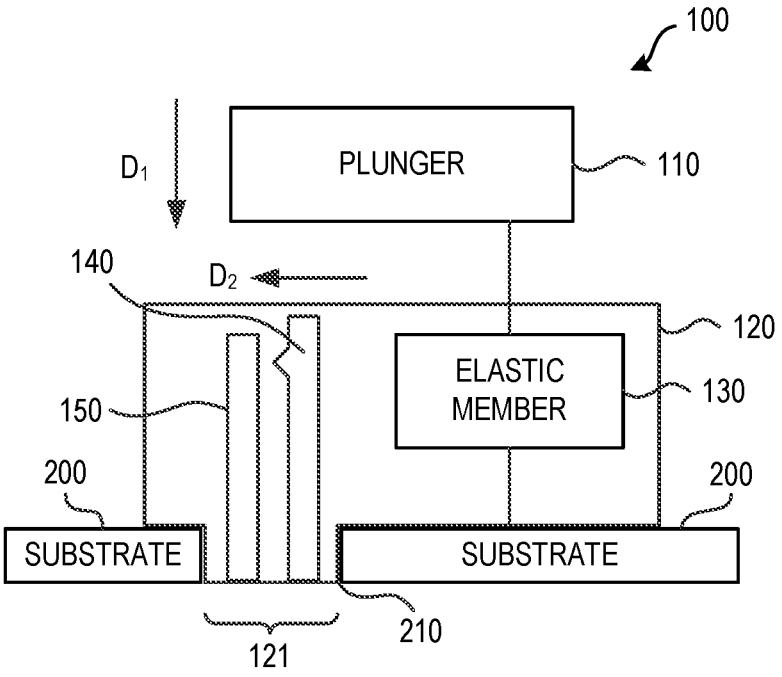
FIG. 1 illustrates a schematic diagram of a switch according to one implementation of the subject matter described herein.

The subject matter described herein will now be discussed with reference to several example implementations. These implementations are discussed only for the purpose of enabling those skilled persons in the art to better understand the subject matter described herein, rather than suggesting any limitations on the scope of the subject matter.

The term "includes" and its variants are to be read as open terms that mean "includes, but is not limited to." The term "or" is to be read as "and/or" unless the context clearly indicates otherwise. The term "based on" is to be read as "based at least in part on." The term "one implementation" and "an implementation" are to be read as "at least one implementation." The term "another implementation" is to be read as "at least one other implementation." Unless specified or limited otherwise, the terms "mounted," "connected," "supported," and "coupled" and variations thereof are used broadly and encompass direct and indirect mountings, connections, supports, and couplings. Further, "connected" and "coupled" are not restricted to physical or mechanical connections or couplings. In the description below, like reference numerals and labels are used to describe the same, similar or corresponding parts in the several views of FIGS. 1-6. Other definitions, explicit and implicit, may be included below.

A switch is widely used in various devices. For example, a keyboard usually uses more than one hundred keys for inputting various characters. Each key or switch corresponds to a particular character so that a corresponding signal will be generated once the key or switch is closed. Such a switch may be realized in a mechanical or an electric manner. A mechanical switch is widely preferred because an end user can actually feel whether the switch has been pressed or not, which speeds up the typing. Different switches provide different striking motions due to their mechanical structures. A delicately designed switch allows a quickly responsive yet smooth striking motion, and thus may result in a favorable product.

A mechanical switch or key usually requires a certain height to provide enough space for its button to travel and for its internal mechanism to be constructed in a robust manner. A reduced thickness or height of the mechanical switch or key is desired because such a low profile key would improve the appearance of the product. However, the size of a mechanical switch is usually difficult to be reduced because this may weaken or compromise the mechanical performance of the switch. For example, the reduction in height typically compromises the durability and typing experience.

FIG. 1 illustrates a schematic diagram of a switch 100 according to one implementation of the subject matter described herein. The switch 100 is described with only for the purpose of illustration without suggesting any limitations as to the scope of the subject matter described herein. Different implementations with different structures can realize the purpose and concept of the subject matter described herein.

As shown, the switch 100 includes a plunger 110 and a housing 120 so that the plunger 110 can be moveable relative to the housing 120 when the plunger 110 is installed to the housing 120. The plunger 110 may be designed to be pressed by a user while the housing is fixed or detachably fixed to a substrate 200 (for example, a printed circuit board or PCB)

of a device such as a keyboard or a gamepad. In other words, the plunger 110 is used to receive a force applied on it in order to be moved reciprocally with respect to the housing 120. The plunger 110 can be located completely out of the housing 120 or partly out of the housing 120. That is, the plunger 110 may or may not take up a certain space defined by the perimeter of the housing 120.

In this implementation, an elastic member 130 may be provided between the plunger 110 and an inner bottom surface of the housing 120. The elastic member 130 may be located inside the housing 120 in such a way that one end of the elastic member 130 is fixed onto the bottom of the plunger 110 and the other end is fixed onto the inner surface of the housing 120. The elastic member 130 can be constructed in various forms such as a helical spring. As the plunger 110 moves towards the inner bottom surface of the housing 120 or towards the substrate 200 when the switch 100 is installed to the substrate 200, the elastic member 130 can be compressed. It would be appreciated that the reactive force applied to the plunger 110 may gradually increase. If the user stops pressing the plunger 110, the reactive force applied by the elastic member 130 will cause the plunger 110 to return to its rest position. It is to be understood that the elastic member 130 can be replaced by any member that is able to return the plunger 130 back to its rest position. That is, a member that may not be elastic is also possible in some situations.

Within the housing 120 there is a protruding portion 121 fitted into an aperture 210 of the substrate 200, thereby fixing the switch 100 to the substrate 200. In some implementations, the substrate 200 may include a number of apertures 210 to receive a plurality of switches 100 constructed with protruding portions 121. In some implementations, the apertures 210 on the substrate 200 may of the same size, so that the switches 100 of the same type are able to be fitted into each of the apertures 210 of the substrate 200.

As illustrated by FIG. 1, a first contact member 140 is provided in the housing 120 which extends from the protruding portion 121 of the housing 120. The first contact member 140 may extend through most of the height of the housing 120 until it approaches an inner top surface of the housing 120. In the illustrated example, the first contact member 140 is simplified as an elongated member that can be deflected towards a second contact member 150 in a second direction $D_2$ upon the plunger 110 moving in a first direction $D_1$. In this example, the second direction $D_2$ is substantially perpendicular to the first direction $D_1$. When a force is exerted on the illustrated elongated member in the second direction $D_2$, the initially straight elongated member is deformed into a curve. If the first contact member 140 is deflected or deformed to a predefined extent, the first contact member 140 and the second contact member 150 form an electrical connection between each other. That is, the first and second contact members 140 and 150 are electronically contacted with one another. The substrate 200 may include additional contact pins in the vicinity of the protruding portion 121 for connecting to the first contact member 140 and the second contact member 150. Therefore, upon the electrical connection between the first contact member 140 and the second contact member 150 being formed, a signal can be passed or generated indicative of the switch 100 being activated.

It is to be understood that the first contact member 140 and the second contact member 150 are not necessarily vertical or perpendicular to the substrate 200. In addition, the first contact member 140 is not necessarily moved in a direction perpendicular to the first direction $D_1$. That is, the second direction $D_2$ does not necessarily have to be normal to the second direction $D_2$.

As described above, the protruding portion 121 of the housing 120 is provided for installing the switch 100 to the aperture 210 of the substrate 200. In this way, an extra room taking up a portion of the substrate 200 is provided for accommodating the first contact member 140. In other words, the first contact member 140 is ensured to have a length contributing to the ease of deflection/deformation (that is, soft enough) even if the height of the housing 120 above the substrate 200 is reduced, because the particular arrangement makes use of a cut-out part of the substrate 200 (the aperture 210). As a result, the first contact member 140 can still be constructed with an appropriate elasticity, allowing the first contact member 140 being deformed reciprocally for millions of times without fatigue. The second contact member 150 may or may not be rigid, and it does not necessarily extend from the protruding portion 121.

It would be appreciated from the above descriptions that the arrangement and configuration of the switch according to the subject matters described herein provide a low-profile switch to be installed to a substrate of a device. The housing 120 may encompass the elastic member 130, the first contact member 140 as well as the second contact member 150, and thus a clean design as seen from the top of the switch 100 can be obtained.

Figure 2:
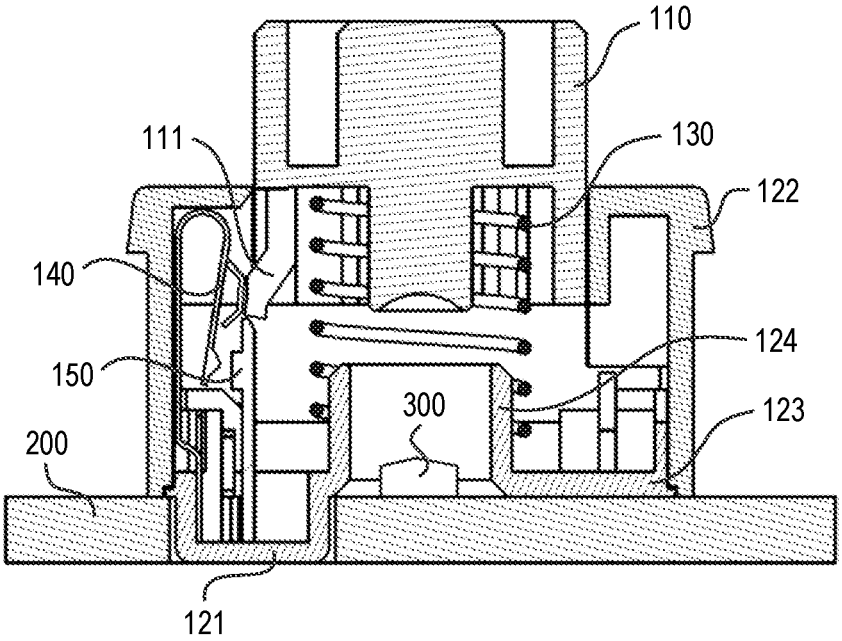
FIG. 2 illustrates a sectional view of an example of the switch according to one implementation of the subject matter described herein.
Figure 3:
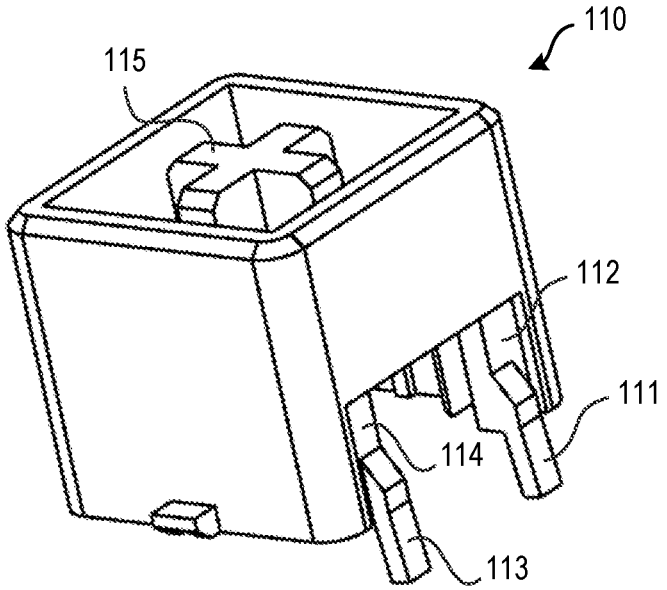
FIG. 3 illustrates a perspective view of the plunger of the switch of FIG. 2.
Figure 4:
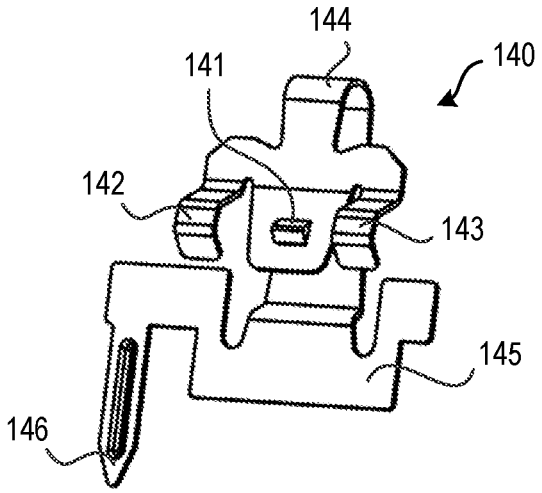
FIG. 4 illustrates a perspective view of the first contact member of the switch of FIG. 2.

FIG. 2 shows a sectional view of an example of the switch 100 according to one implementation of the subject matter described herein. FIG. 3 illustrates a perspective view of the plunger 110 of FIG. 2. FIG. 4 illustrates a perspective view of the first contact member 140 of FIG. 2. In this implementation, the substrate 200 is provided at the bottom of the switch 100 for supporting the entire structure, and the switch 100 is positioned onto the substrate 200 by fitting the protruding portion 121 to the aperture 210 of the substrate 200.

As shown in FIG. 2, in this implementation, the housing 120 includes a base 123 and a circumferential wall 122. The shapes, sizes and forms of the base 123 and the circumferential wall 122 are not to be limited as long as they can be mated with each other. The housing 120 may include a member such as a hook (not shown) in order to prevent the plunger 110 from moving out of the housing 120 by the elastic member 130 when the user is not pressing the plunger 110. The protruding portion 121 is formed on the base 123. In some implementations, the protruding portion 121 can be formed as a part of the base 123 of the housing 120. A cylindrical portion 124 can be formed on the base 123 of the housing 120, particularly at the center of the base 123. The cylindrical portion 124 and the housing 120 can be coaxial when the base 123 is fixed to the circumferential wall 122. The cylindrical portion 124 can be coaxially positioned in relation to the plunger 110 as well. The elastic member 130 is shown to be a helical spring surrounding the cylindrical portion 124, so that it can be positioned substantially at the center of the housing 120 as the cylindrical portion 124 is centered within the housing 120. Therefore, the switch 100 may have a common centerline for the cylindrical portion 124, the circumferential wall 122, the elastic portion 130 as well as the plunger 110, which is parallel with the first direction $D_1$.

In one implementation, as discussed above, the elastic member 130 may be a helical spring or coil spring in order to provide a fast response to the applied force on the plunger 110. Alternatively, in other implementations, any other elastic member providing a responsive reactive force to the striking motion can be used. The elastic member 130 may be able to be compressed linearly and thus the striking motion is smooth. Additionally, the elastic member 130 surrounds the cylindrical portion 124, which may allow a larger size of the elastic member 130. As a result, a better feeling yet low profile elastic member 130 can be achieved.

A light source 300 can be provided on the substrate 200. In one implementation, the light source 300 is centered in relation to the housing 120 or plunger 110 after the switch 100 is installed to the substrate. In other words, the light source 300 can be seated on the centerline as discussed above. In some situations, the light source 300 and the plunger 110 can be positioned along a line parallel to the centerline (or to the first direction $D_1$ as seen in FIG. 1). The light source 300 may be a light emitting diode (LED) or other suitable source that is able to emit desirable lights. In one example, at least a part of the cylindrical portion 124 and at least a part of the plunger 110 are optically transparent along the centerline (or in the first direction $D_1$ as seen in FIG. 1) so that the lights or rays from the light source 300 is able to pass through the cylindrical portion 124 and the plunger 110 along the centerline and out of the switch 100. That is, the center portion of the plunger 110 can be illuminated by the light source 300. In existing products, keys may only be illuminated off its centerline due to the structural limitations. The structure according to the subject matters described herein allows a center-positioned illumination of a key (switch), and thus a better appearance may be achieved by centering a printed character on the plunger.

In the example illustrated in FIG. 2, the first contact member 140 extends from the protruding portion 121, through the height of the circumferential wall 122 up to the inner upper surface of the housing 120 (or the circumferential wall 122). Then, the first contact member 140 extends downwards to a certain extent. Consequently, the first contact member 140 is formed to be of an inverted "U" shape, as shown in FIG. 2. However, it is to be understood that the shape illustrated by FIG. 2 is just an example, and there may be other shapes suitable for the first contact member 140. The first contact member 140 is bended or deflected by an engaging member 111 of the plunger 110 when the plunger 110 is not pressed by the user, namely, in its rest position. As such, the bended or deflected first contact member 140 is not electrically connected to the second contact member 150.

When the plunger 110 is pushed or pressed by the user towards the substrate 200, the engaging member 111 may allow an end of the first contact member 140 gradually moving towards the second contact member 150 until the first and second contact members 140 and 150 are electrically connected. In other words, the engaging member 111 is operable to deform the second contact member 140 in the second direction $D_2$ based at least in part on the plunger 110 being moved in the first direction $D_1$, as explained above by reference to FIG. 1. When the user stops pressing the plunger 110, the plunger 110 will be pushed back to its rest position by the elastic member 130, and consequently the engaging member 111 disconnect the first contact member 140 from the second contact member 150. By the above described motions of the plunger 110 together with its engaging member 111, the first contact member 140 can be connected to or disconnected from the second contact member 150. As such, the switch 100 can be operated smoothly.

In this implementation, the protruding portion 121 extends through a thickness of the substrate 200 to allow a utilization of the space as much as possible for accommodating the first and second contact members 140 and 150. Each of the first and second contact members 140 and 150 is able to form a detachable electrical connection to additional pin(s) of the device, so that a current flows through the connected first and second contact members 140 and 150. In this regard, the switch 100 can be regarded as a pressure sensor which passes through a signal indicative of a pressure exerted onto the plunger 110. The first and second contact members 140 and 150 may or may not extend out of the protruding portion 121, and they can be configured in various existing forms to be detachably connected to the pins of the device.

As shown in FIGS. 3 and 4, the plunger 110 may have a pair of engaging members 111, 113 for deforming the first contact member 140 at a pair of protruding arms 142, 143 with respect to a U-shaped turn 144. As a result, when the plunger 110 is in its rest position (not pressed by the user), a contact 141 of the first contact member 140 will be separated from the second contact member 150. Based at least in part on the plunger 110 being moved downwards as illustrated in FIG. 2, the pair of protruding arms 142, 143 of the first contact member 140 will be positioned against a pair of recesses 112, 114, making the contact 141 moving towards the second contact member 150 and eventually connecting to the second contact member 150.

In this implementation, the bottom side 145 of the first contact member 140 can be located on an inner surface of the protruding member 121 at the bottom, and a pin 146 may be provided to penetrate through the bottom of the protruding member 121 so as to form a detachable connection to the device. As discussed previously, the plunger 110 may have an optically transparent portion extending in the centerline, so that in case that the light source 300 is provided, an upper portion 115 of the plunger 110 (the cross-shaped surface as shown in FIG. 3) can be illuminated. Therefore, a plate to be fitted to the top of the plunger 110 on which a particular character is printed can be used with the plunger 110 according to the implementations of the present disclosure.

According to implementations of the subject matter described herein, there may be one or more elastic members 130. In some implementations, a single helical or coil spring may be used as the elastic member 130, as described above. In alternative implementations, multiple springs may be used to function as multiple elastic members 130. Likewise, the number of the first and second contact members 140 and 150 is not to be limited as well. The elasticity or spring constant of the elastic member or the contact members is not to be limited.

The switch in accordance with the implementations of the subject matter described herein provides a low profile housing of the switch as described above, which is capable of providing a deflectable contact member that has a length allowing a smooth and quickly responsive striking motion in order to improve the input experience as well as the durability. Meanwhile, the relatively simple arrangement of the components of the switch results in a clean appearance and easy assembly.

The above examples are described only for the purpose of illustration, without suggesting any limitations as to the scope of the subject matter described herein. Any additional or alternative materials can be used to make the components of the switch.

It is to be understood that "top", "bottom", "front", "rear", "side", "lateral" and the like are only used to describe the relationship between the components in the figures, instead of limiting their orientation or positioning. For example, in FIG. 2, the plunger 110 can be seen as being placed above the cylindrical portion 124, and can also be seen as being placed underneath the cylindrical portion 124.

Figure 5:
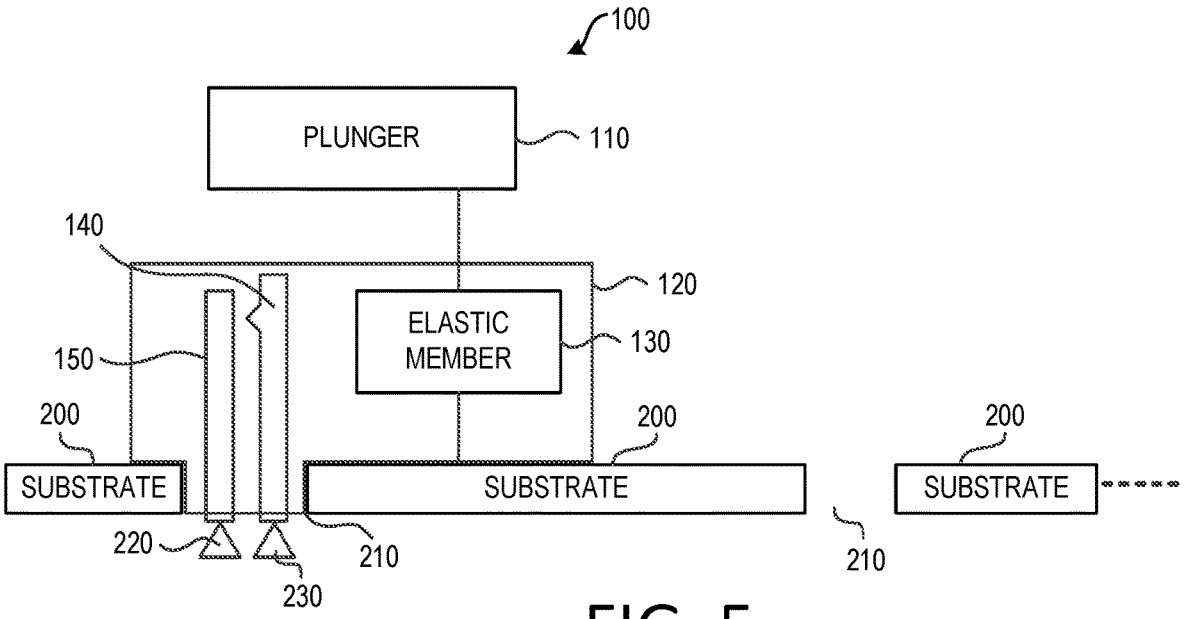
FIG. 5 illustrates a block diagram of a keyboard according to one implementation of the subject matter described herein.

The switch 100 may be used in a variety of devices. For example, the switch 100 may be used to form a keyboard as shown in FIG. 5. In this implementation, the keyboard includes a substrate 200 having a plurality of apertures 210, and a plurality of keys 100 detachably connected to the substrate. Each of the keys includes: a housing 120 having a protruding portion 121 configured to be received in an aperture 210 formed on a substrate 200, a plunger 110 operable to move with respect to the housing, a first contact member 140 located in the housing, and a second contact member 150 extending from the protruding portion of the housing. The second contact member being operable to, based at least in part on the plunger being moved in a first direction, deform to a predefined extent to electrically contact the first contact member. Each of the keys 100 is already described above by reference to FIGS. 1 to 4, and thus detailed explanations to its configuration, structure or function are not to be repeated, because the key 100 can be constructed exactly the same as the switch 100 described above.

Figure 6:
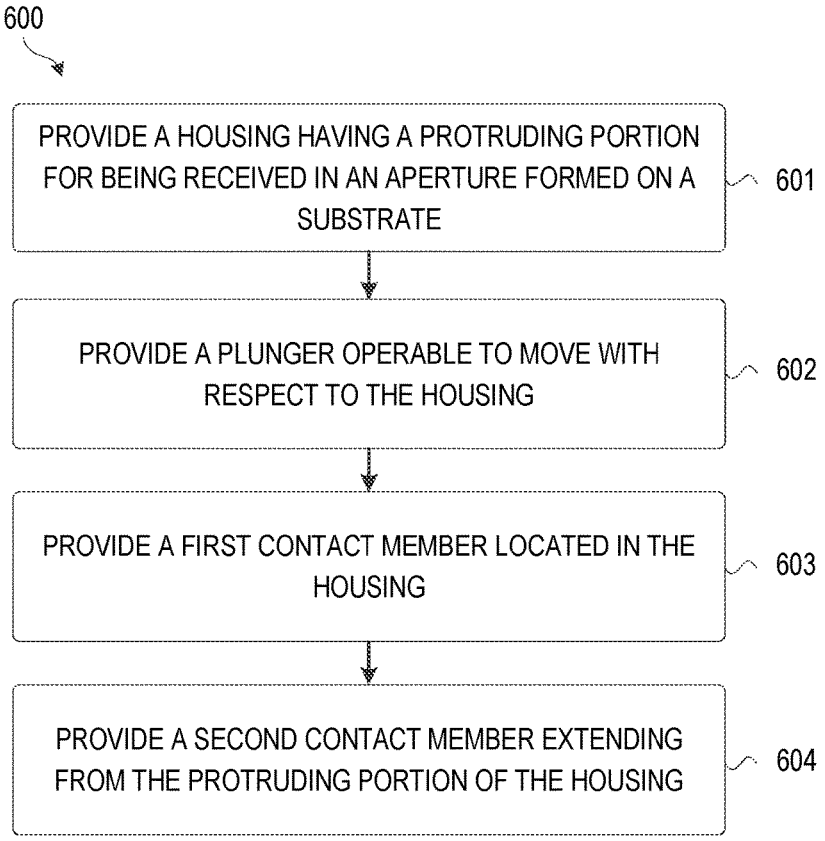
FIG. 6 illustrates a flowchart of a method of manufacturing the switch in accordance with implementations of the subject matter described herein.

FIG. 6 illustrates a flowchart of a method 600 of manufacturing the switch 100 in accordance with implementations of the subject matter described herein. The method 600 is entered in step 601, where a housing having a protruding portion configured to be received in an aperture formed on a substrate is provided.

In step 602, a plunger operable to move with respect to the housing is provided. Then, in step 603, a first contact member located in the housing is provided. Finally, in step 604, a second contact member extending from the protruding portion of the housing is provided. The second contact member is operable to, based at least in part on the plunger being moved in a first direction, deform to a predefined extent to electrically contact the first contact member. Each of the switch is already described above by reference to FIGS. 1 to 4, and thus detailed explanations to its configuration, structure or function are not to be repeated, because the switch can be constructed exactly the same as the switch 100 described above.

While operations are depicted in a particular order in the above descriptions, this should not be understood as requiring that such operations be performed in the particular order shown or in sequential order, or that all illustrated operations be performed, to achieve desirable results. In certain circumstances, multitasking and parallel processing may be advantageous. Likewise, while several details are contained in the above discussions, these should not be construed as limitations on the scope of the subject matter described herein, but rather as descriptions of features that may be specific to particular implementations. Certain features that are described in the context of separate implementations may also be implemented in combination in a single implementation. On the other hand, various features that are described in the context of a single implementation may also be implemented in multiple implementations separately or in any suitable sub-combination.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

The invention claimed is:

1. A key switch comprising:

a key-switch housing received into a well of a substrate;

first and second electrically conductive contact members, the first contact member including a resiliently deformable, elongate conductor extending down the key-switch housing and into the well of the substrate;

a key-switch plunger resiliently coupled to the key-switch housing and configured to transmit a force to the first contact member to deformably move the first contact member into electrical contact with the second contact member;

a cylindrical portion arranged on a base of the key-switch housing; and an elastic member including a helical spring surrounding the cylindrical portion, the elastic member arranged between the key-switch plunger and an inner bottom surface of the key-switch housing, deformable by force applied on the key-switch plunger and configured to bias the key-switch plunger toward a rest position.

2. The key switch according to claim 1, wherein the first contact member extends from a protruding portion of the key-switch housing to an inner upper surface of the key-switch housing.

3. The key switch according to claim 1, further comprising:

an engaging member arranged on the key-switch plunger and operable to deform the first contact member in a second direction based at least in part on the key-switch plunger being moved in a first direction, the second direction being substantially perpendicular to the first direction.

4. The key switch according to claim 1, wherein at least a part of the key-switch plunger and at least a part of the cylindrical portion are optically transparent in a first direction to allow light emitted from a light source located on the substrate to pass through the cylindrical portion and the key-switch plunger, and wherein the first direction is a direction of the force applied to the key-switch plunger.

5. The key switch according to claim 1, wherein a protruding portion of the key-switch housing is formed as a part of the base of the key-switch housing.

6. The key switch according to claim 1, wherein the cylindrical portion and the key-switch housing are coaxial.

7. The key switch according to claim 4, wherein the key-switch plunger and the light source are positioned along a line parallel to the first direction.

8. The key switch according to claim 4, wherein the key-switch plunger and the light source are positioned along a line parallel to the first direction.

9. A keyboard comprising:

a substrate having a plurality of apertures;

a plurality of keys detachably connected to the substrate, each of the plurality of keys including:

a key-switch housing having a protruding portion configured to be received into one of the plurality of apertures, first and second electrically conductive contact members, the first contact member including a resiliently deformable, elongate conductor extending down the key-switch housing and into the one of the plurality of apertures, a key-switch plunger resiliently coupled to the key-switch housing and configured to transmit a force to the first contact member to deformably move the first contact member into electrical contact with the second contact member;

a cylindrical portion arranged on a base of the key-switch housing; and an elastic member including a helical spring surrounding the cylindrical portion, the elastic member arranged between the key-switch plunger and an inner bottom surface of the key-switch housing, deformable by force applied on the key-switch plunger and configured to bias the key-switch plunger toward a rest position.

10. The keyboard according to claim 9, wherein the first contact member extends from the protruding portion to an inner upper surface of the key-switch housing.

11. The keyboard according to claim 9, wherein the key further comprises:

an engaging member arranged on the key-switch plunger and operable to deform the first contact member in a second direction based at least in part on the key-switch plunger being moved in a first direction, the second direction being substantially perpendicular to the first direction.

12. The keyboard according to claim 9, wherein at least a part of the key-switch plunger and at least a part of the cylindrical portion are optically transparent in a first direction to allow light emitted from a light source located on the substrate to pass through the cylindrical portion and the key-switch plunger, and wherein the first direction is a direction of the force applied to the key-switch plunger.

13. The keyboard according to claim 9, wherein the protruding portion is formed as a part of the base of the key-switch housing.

14. The keyboard according to claim 9, wherein the cylindrical portion and the key-switch housing are coaxial.

15. A method enacted in a keyboard having a substrate with a plurality of apertures and a corresponding plurality of keys detachably connected to the substrate, the method comprising, for each key:

pursuant to force applied to a key-switch plunger of the key, causing the key-switch plunger to move in a first direction relative to a key-switch housing of the key, the key-switch housing having a protruding portion received in one of the plurality of apertures; and pursuant to the plunger moving in the first direction, causing a first contact member to deform to electrically contact a second contact member in the key-switch housing, the first contact member including a resiliently deformable, elongate conductor extending down the protruding portion of the key-switch housing and into the one of the plurality of apertures, wherein the key includes a cylindrical portion arranged on a base of the key-switch housing and an elastic member including a helical spring surrounding the cylindrical portion, the elastic member arranged between the key-switch plunger and an inner bottom surface of the key-switch housing, deformable by the force applied on the key-switch plunger and configured to bias the key-switch plunger toward a rest position.

16. The method according to claim 15, wherein the protruding portion is formed as a part of the base of the key-switch housing.

17. The method according to claim 15, wherein the cylindrical portion and the key-switch housing are coaxial.

18. The method according to claim 15, wherein the key-switch plunger and the light source are positioned along a line parallel to the first direction.

19. The method according to claim 15, wherein the key further comprises an engaging member arranged on the key-switch plunger and operable to deform the first contact member in a second direction based at least in part on the key-switch plunger being moved in the first direction, the second direction being substantially perpendicular to the first direction.

* * * * *